US005679183A

United States Patent [19]

Takagi et al.

[11] Patent Number: 5,679,183

[45] Date of Patent: Oct. 21, 1997

[54] METHOD FOR MAKING α+β TITANIUM ALLOY

[75] Inventors: Shin-ichi Takagi, Yokohama; Atsushi Ogawa, Kawasaki; Kuninori Minakawa, Mitaka, all of Japan

[73] Assignee: NKK Corporation, Tokyo, Japan

[21] Appl. No.: 564,923

[22] Filed: Nov. 29, 1995

[30] Foreign Application Priority Data

Dec. 5, 1994 [JP] Japan ..... 6-329269
Dec. 28, 1994 [JP] Japan ..... 6-337767

[51] Int. Cl.[6] ..... C22F 1/18

[52] U.S. Cl. ..... 148/671; 148/670

[58] Field of Search ..... 148/670, 671

[56] References Cited

U.S. PATENT DOCUMENTS

| | | | |
|---|---|---|---|
| 3,748,194 | 7/1973 | Ruckle et al. . | |
| 3,867,208 | 2/1975 | Grekov et al. . | |
| 3,901,743 | 8/1975 | Sprague et al. . | |
| 4,842,652 | 6/1989 | Smith et al. . | |
| 4,902,355 | 2/1990 | Jaffee et al. . | |
| 4,975,125 | 12/1990 | Chakrabarti et al. . | |
| 5,399,212 | 3/1995 | Chakrabarti et al. | 148/671 |
| 5,411,614 | 5/1995 | Ogawa et al. | 148/670 |

FOREIGN PATENT DOCUMENTS

| | | | |
|---|---|---|---|
| 0 307 386 | 3/1989 | European Pat. Off. . | |
| 0 408 313 | 1/1991 | European Pat. Off. . | |
| 2 162 843 | 7/1973 | France . | |
| 2 162 856 | 7/1973 | France . | |
| 2 623 523 | 5/1989 | France . | |
| 38 04 358 | 8/1989 | Germany . | |
| 50-37004 | 11/1975 | Japan . | |
| 61-194163 | 8/1986 | Japan . | |
| 62-133051 | 6/1987 | Japan | 148/671 |
| 3-274238 | 12/1991 | Japan . | |
| 2009754 | 3/1994 | U.S.S.R. | 148/670 |
| 2 148 940 | 6/1985 | United Kingdom . | |

*Primary Examiner*—John Sheehan
*Attorney, Agent, or Firm*—Frishauf, Holtz, Goodman, Langer & Chick, P.C.

[57] ABSTRACT

A method for making an α+β titanium alloy comprising: preparing an α+β titanium alloy, hot-working the titanium alloy in an α+β phase region, heating and then heat treating the hot-worked titanium alloy to a temperature from the β-transus minus 55° C. to the β-transus minus 10° C., air cooling the heat treated titanium alloy, heating and then heat treating the air cooled titanium alloy to a temperature from the β-transus minus 250° C. to the β-transus minus 120° C., and air cooling the heat treated titanium alloy.

20 Claims, 3 Drawing Sheets

METHOD FOR MAKING α+β TITANIUM ALLOY

BACKGROUND OF THE INVENTION

1. Field of the Invention

The present invention relates to a method for making an α+β alloy, and more particularly relates to a method for making an α+β alloy wherein fracture toughness can be improved.

2. Description of the Related Arts

Fracture toughness of an α+β titanium alloy significantly varies with the type of microstructure. It is known that β heat-treated microstructure having coarse acicular α colonies generally shows superior fracture toughness compared with equiaxed fine microstructure.

At the same strength level, ductility decreases with the change of microstructure from an equiaxed fine microstructure to a β heat-treated microstructure. Further, the ductility is deteriorated by developing a coarse microstructure. These phenomena suggest that it is difficult in an α+β titanium alloy to have both high ductility and high toughness well-balanced.

As for the strength, the fracture toughness generally decreases with the increase of strength. Solution treatment and aging can be used as a method to increase the strength of an α+β titanium alloy. This method, however, is not expected to give high fracture toughness because of the resulted equiaxed fine microstructure thereof.

A balanced improvement of fracture toughness, ductility, and strength of an α+β titanium alloy has been desired, and several means for the improvement have been disclosed.

For example, in JP-B-50-37004 (the term "JP-B-" referred to herein stands for "Japanese examined patent publication"), the Prior Art 1, discloses a method for increasing toughness by heating and holding an α+β titanium alloy at a temperature range of from β-transus minus 150° C. to β-transus minus 60° C. to maintain an α+β microstructure, and then by air-cooling or cooling at a higher speed than air-cooling, followed by stabilizing heat treatment. In JP-A-61-194163 (the term "JP-A-" referred to herein stands for "Japanese unexamined patent publication"), the Prior Art 2 discloses that high toughness of an α+β titanium alloy is achieved by heating and holding the hot-worked alloy at a temperature range of from β-transus minus 50° C. to β-transus minus 10° C., followed by cooling the α+β titanium alloy to 500° C. or lower at a cooling rate of 0.1° to 5° C./sec.

The Prior Arts 1 and 2 have disadvantages described below. Both of them intend to acquire balance of high toughness and ductility at the same time by preparing the microstructure with primary α phase and transformed β structure in which an acicular α phase precipitates. The presence of acicular α phase presumably plays an important role in increasing the toughness. Nevertheless, the acicular α phase precipitates during the cooling step after the heat treatment, so the pattern of precipitation strongly depends on the stability of the β phase of the alloy.

Prior Art 1 and Prior Art 2 specify the cooling rate after the heating and holding step as "air-cooling or higher than the air-cooling" and "a cooling rate ranging from 0.1° to 5° C./sec", respectively. Those levels of cooling rate are not necessarily effective to improve the toughness of all types of α+β titanium alloys. The reason is that the stability of β phase considerably depends on the kinds of the elements of the α+β titanium alloy, and that the cooling rate specified by the Prior Arts is not necessarily optimum for the precipitation of acicular α phase effective for improving the fracture toughness.

Accordingly, it was found that for an α+β titanium alloy having a relatively high stability of β phase, high toughness can not be attained by using the means disclosed by these Prior Arts. In this respect, the inventors of the present invention proposed a Ti-4.5Al-3V-2Mo-2Fe alloy (β-transus temperature being 900° C.) as an α+β titanium alloy that has an excellent superplastic formability in JP-A-3-274238. The alloy of JP-A-3-274238 provides high hot-working properties, high strength, and high ductility. The alloy, however, has a relatively high stability of β phase, and therefore the methods disclosed in the above-described Prior Arts could not give sufficiently high fracture toughness.

SUMMARY OF THE INVENTION

It is an object of the present invention to provide a method for making an α+β titanium alloy wherein the toughness can be improved while balancing the strength, ductility and toughness.

To attain the object, the present invention provides a method for making an α+β titanium alloy comprising the steps of;

(a) preparing an α+β titanium alloy having a Mo.eq. of 2 to 10 wt. %, the Mo.eq. being defined by the following equation:

$$\text{Mo.eq.}=\text{Mo}+0.67\times\text{V}+0.44\times\text{W}+0.28\times\text{Nb}+0.22\times\text{Ta}+2.9\times\text{Fe}+1.6\times\text{Cr}+1.1\times\text{Ni}+1.4\times\text{Co}+0.77\times\text{Cu}-\text{Al}$$

(b) hot-working the titanium alloy in an α+β phase region;

(c) heating the hot-worked titanium alloy to a temperature ranging from β-transus minus 55° C. to β-transus minus 10° C.;

(d) heat treating the heated titanium alloy at the temperature ranging from β-transus minus 55° C. to β-transus minus 10° C.;

(e) air cooling the heat treated titanium alloy;

(f) heating the air cooled titanium alloy to a temperature ranging from β-transus minus 250° C. to β-transus minus 120° C.;

(g) heat treating the heated titanium alloy at the temperature ranging from β-transus minus 250° C. to β-transus minus 120° C.; and (h) air cooling the heat treated titanium alloy.

Furthermore, the present invention provides a method for making an α+β titanium alloy comprising the steps of;

(a) preparing an α+β titanium alloy consisting essentially of 3 to 5 wt. % Al, 2.1 to 3.7 wt. % V, 0.85 to 3.15 wt. % Mo, 0.85 to 3.15 wt. % Fe, 0.06 to 0.2 wt. % 0 and the titanium alloy satisfying the following equation:

$$7\text{ wt. }\% \leqq 0.67\times\text{V}+2.9\times\text{Fe}+\text{Mo} \leqq 13\text{ wt. }\%.$$

(b) hot-working the titanium alloy in an α+β phase region;

(c) heating the hot-worked titanium alloy to a temperature ranging from β-transus minus 55° C. to β-transus minus 10° C.;

(d) heat treating the heated titanium alloy at the temperature ranging from β-transus minus 55° C. to β-transus minus 10° C.;

(e) air cooling the heat treated titanium alloy;

(f) heating the air cooled titanium alloy to a temperature ranging from β-transus minus 250° C. to β-transus minus 120° C.;

(g) heat treating the heated titanium alloy at the temperature ranging from β-transus minus 250° C. to β-transus minus 120° C.; and (h) air cooling the heat treated titanium alloy.

DESCRIPTION OF THE PREFERRED EMBODIMENT

The inventors of the present invention conducted an extensive study for the balanced improvement of toughness, ductility, and strength of an α+β titanium alloy that has a relatively high stability of the β phase, and obtained the following-described findings. That is, the increase of fracture toughness is possible without deteriorating ductility by a series of treatment steps of: hot-working an α+β titanium alloy having a relatively high stability of the β phase in the α+β phase region; holding the titanium alloy at a heated temperature ranging from the β-transus minus 55° C. to the β-transus minus 10° C., followed by cooling; re-heating the titanium alloy at a temperature range of from the β-transus minus 250° C. to the β-transus minus 120° C., followed by cooling. The hot-working of the alloy in the α+β phase includes various types of working such as rolling and forging performed in a temperature range where both the α and β phases exist below the β transus.

The reason why the heat treatment condition is specified as above for increasing the fracture toughness is given below. In an α+β titanium alloy, the β phase becomes stable with an increase in temperature. In an α+β phase region, the volume fraction of the β phase increases with the increase in temperature. The phenomenon indicates that the stability of α phase increases at a lower temperature level. Accordingly, during the cooling period after heating, the α phase substitutes for a super-saturated β phase.

For this reason, the volume fraction of the β phase which becomes supersaturated during cooling stage increases as higher temperatures are used for the heat treatment, and a larger amount of the β phase is replaced by the α phase during the cooling stage. When the β phase is replaced by the α phase during the cooling stage, the α phase precipitates in an acicular shape in the β phase matrix. At this moment, it is known that there is a correlation of crystal habit called the "Burgers orientation" between the α phase and the β phase.

Figure 1:
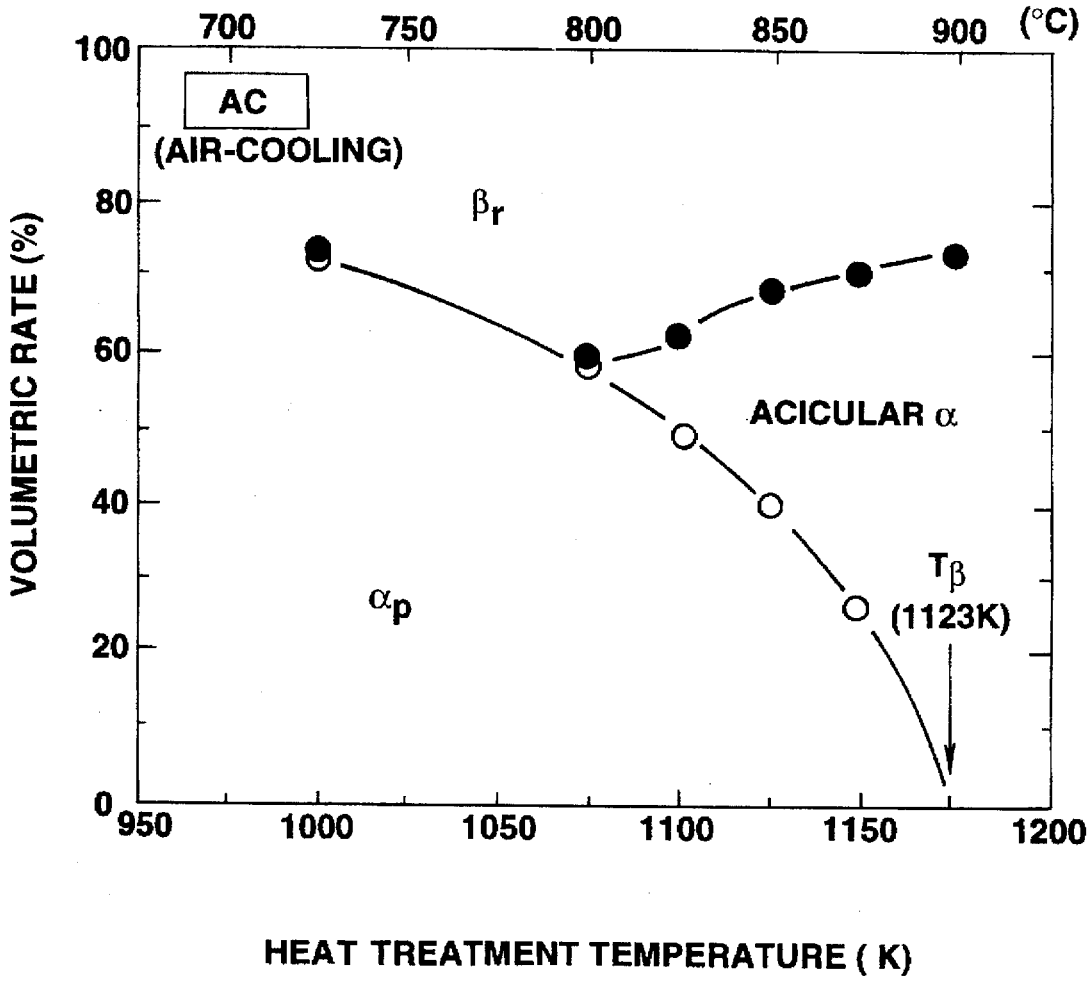
FIG. 1 is a graph which shows a relation between heat treatment temperature and microstructure of a Ti-4.5Al-3V-2Mo-2Fe alloy.

As for microstructure, when the alloy was hot-worked in an α+β phase region, followed by heating to a temperature below the β transus and then cooling, it shows a bi-modal microstructure comprising an equiaxed α phase and a transformed β phase into which the acicular α phase precipitates. FIG. 1 shows a change of volume fraction of the equiaxed α phase, the acicular α phase, and the β phase of a Ti-4.5Al-3V-2Mo-2Fe alloy (the β transus temperature being 900° C.), a kind of an α+β titanium alloy that has a relatively high stability of β phase and was developed by the inventor prior to the present invention. Before the measurement, the alloy was subjected to a hot working such as rolling or forging having a reduction of area of 30% or more in the α+β phase region, and the hot worked alloy was heated to various temperatures, followed by air-cooling. In the FIG. 1, $\alpha_P$ denotes primary α phase and βr denotes retained βphase.

A higher degree of hot-working in the α+β phase region enhances the formation of a uniform and fine microstructure, while inducing not much change of above-described volume fraction of the equiaxed α phase, the acicular α phase, and the β phase. A preferable degree of hot-working from the stand point of practical application is 5% or more, and most preferably 30% or more.

As seen in FIG. 1, when hot-working given in the above-described α+β phase is followed by heating and holding at 800° C., which is the temperature of the β-transus minus 100° C., and further by air-cooling, the volume fraction of the β phase become largest. Heat treatment at higher temperatures than 800° C. generates precipitation of the acicular α phase.

That type of bi-modal microstructure is taken as a structure having high toughness in the prior art. The reason is presumably that effective stress intensity factor decreases because of branching the cracks—the phenomenon specific to the acicular α microstructure, that the high ductility is maintained by the presence of a primary α phase, that the energy absorption accompanied with a diminishing crack development before the stable crack propagation increases, and that these variables contribute to the increase of toughness in a synergetic manner.

In an α+β titanium alloy that has a relatively high stability of β phase, however, the appeared acicular α phase is very fine and is effective for increasing the strength. Nevertheless, the fineness was found to be too small to increase the toughness. The inventors of the present invention further conducted a study to attain both high fracture toughness and high ductility at the same time, and derived a solution to increase the toughness by applying a heat treatment to the alloy in an α+β phase region ranging from the β-transus minus 55° C. to the β-transus minus 10° C. and further by re-heating after cooling.

In this case, it is preferable that the second heat treatment is performed in a temperature range of from the β-transus minus 250° C. to the β-transus minus 120° C. because the secondary heat treatment makes the fine acicular α phase coarse enough to improve the toughness without making the total microstructure coarse. Thus, the fracture toughness of the alloy has successfully been increased, while maintaining both the strength and the ductility at a high level. The period of heat treatment is not specifically limited. For a practical application, however, the preferable heat treatment period is 30 minutes or more, and more preferably 60 minutes or more.

When the first heat treatment is conducted at the β-transus minus 100° C. or more, the precipitation of the acicular α phase occurs after air-cooling. At a temperature range of from the ⊕-transus minus 100° C. to less than the β-transus minus 55° C., however, the precipitated acicular α phase that appears after the air-cooling becomes very fine, and therefore the secondary heat treatment needs a long period for making the phase coarse enough to contribute to increasing fracture toughness. That is not practical. On the other hand, when the first heat treatment exceeds the β-transus minus 10° C., the total microstructure becomes coarse, and the ductility deteriorates.

Consequently, the temperature range of the first heat treatment is specified to be from β-transus minus 55° C. and β-transus minus 10° C. The heat treatment within this range attains favorable properties of, for example, 950 MPa or more of tensile strength, 35% or more of reduction of area, and 80 MPa•$m^{1/2}$ or more of fracture toughness ($K_{IC}$).

The reason for specifying the composition of the α+β titanium alloy to be processed by the method of the present invention is described below.

Among the component elements, the effect of the elements which contribute to the stability of β phase is defined by the following quantitative equation (1), based on the effect of Mo as 1, $$\text{Mo.eq.}-\text{Mo}+0.67\times\text{V}+0.44\times\text{W}+0.28\times\text{Nb}+0.22\times\text{Ta}+2.9\times\text{Fe}+1.6\times\text{Cr}+1.1\times\text{Ni}+1.4\times\text{Co}+0.77\times\text{Cu}-\text{Al} \quad (1)$$

where each component is expressed by wt. %.

An alloy that has relatively high stability of β phase has a Mo.eq. value of from 2 to 10 wt. %. That type of alloy is applicable for the method of the present invention to increase fracture toughness. If the Mo.eq. value is within the range, the method of the invention is applicable even when the alloy contains neutral elements such as Sn and Zr, which do not affect Mo.eq., and contains a slight amount (usually in arrange of from 0.01 to 0.5 wt. %) of Si, Pd, and Ru, which could enhance creep resistance and corrosion resistance, and further contains inevitable impurities such as O, C, N, and H.

The method of the present invention is more applicable when the composition of the alloy satisfies the following.

Al: 3 to 5 wt. %

Aluminum is an α-stabilizer, and has an effect to enhance the solid-solution strengthening of α phase. Thus, aluminum is an essential element for increasing the strength of an α+β titanium alloy. An aluminum content of less than 3 wt. % gives, however, insufficient strength, and that of above 5 wt. % results in an excessively stable α phase to increase the resistance to deformation, which is unfavorable. Therefore, the aluminum content range is determined to be 3.0 to 5.0 wt. %, and more preferably 3.4 to 5 wt. %.

V: 2.1 to 3.7 wt. %

Vanadium has an effect of lowering the β-transus and stabilizing the β phase. The addition of vanadium improves the hot-workability and induces the precipitation of fine acicular α phase in the β phase during the cooling stage after the heat treatment to improve the strength and the fracture toughness. A vanadium content of less than 2.1 wt. % results in an insufficient lowering of the β-transus, and no improvement of workability is expected. In addition, the acicular α phase precipitated tends to become coarse, and it is not expected to obtain high strength. On the other hand, the vanadium content of above 3.7 wt. % results in an excessively stable α phase, and the precipitation of the acicular α phase which contributes to difficulties for increasing strength and fracture toughness. In addition, excess vanadium content is not economical. Consequently, the content of vanadium is determined to be 2.1 to 3.7 wt. %, and a more preferable range is 2.5 to 3.7 wt. %.

Mo: 0.85 to 3.15 wt. %

Molybdenum has effects of lowering the β-transus, stabilizing the β phase, and suppressing the growth of crystal grains to provide fine crystal grains. Therefore, molybdenum has an effect of improving the workability. At a molybdenum content of below 0.85 wt. %, however, a fine structure is not attained. With a molybdenum content of above 3.15 wt. %, the prepared β phase becomes excessively stable, and an improvement of strength and toughness is not easy. Accordingly, the content of molybdenum is determined to be 0.85 to 3.15 wt. %, and a more preferable range is 0.85 to 2.4 wt. %.

Fe: 0.85 to 3.15 wt. %

Similar to vanadium and molybdenum, iron also has effects to lower the β-transus and stabilize the β phase. In addition, iron has a function to make the solid-solution strengthening of the β phase. Therefore, iron is effective for improving workability, strength, and toughness. At an iron content of below 0.85 wt. %, however, the stability of β phase is insufficient. On the other hand, an iron content of above 3.15 wt. % likely induces the generation of a domain where an irregular β phase called "β fleck" appears, which degrades the uniformity of structure. Therefore, the content of iron is specified to be 0.85 to 3.15 wt. %.

O: 0.06 to 0.2 wt. %

The same oxygen content level as that in an ordinary α+β titanium alloy is preferable. The oxygen content below 0.06 wt. %, however, fails to maintain sufficient strength. The oxygen content above 0.2 wt. % induces a sudden deterioration of ductility and workability. Consequently, the content of oxygen is specified to be 0.06 to 0.2 wt. %.

The reason of limiting the content of V, Fe, and Mo to a range specified by eq.(2) is described below.

$$7\text{ wt. }\% \leqq 0.67\times\text{V}+2.9\times\text{Fe}+\text{Mo} \leqq 13\text{ wt. }\% \quad (2)$$

Iron, vanadium, and molybdenum are the elements to stabilize β phase as described above. They lower the β-transus and have a function to stabilize the β phase at an even lower temperature level, though there is some difference in effectiveness among them. The stability of the β phase gives a significant effect on the mechanical properties of the α+β titanium alloy. That is, the stability of the β phase gives a considerable effect to the microstructure, depending on the heating temperature of the α+β titanium alloy, the volume fraction of the primary α phase, the precipitated style of the α acicular phase, and their dependency on cooling rate. Accordingly, in an α+β titanium alloy having balanced properties of workability, strength, toughness, and ductility, which is a target of the present invention, these β-stabilizing elements need to be controlled within an optimum range.

As described before, the stability of the β phase is expressed quantitatively by a general eq.(1). In eq.(1), an alloy which does not contain W, Nb, Ta, Cr, Ni, Co, and Cu, the values of these elements may be taken as zero. When the Al content is in a range of from 3 to 5 wt. % as specified above, eq.(1) is reduced to the following equation.

$$5\text{ to }7\text{ wt. }\% \leqq 0.67\times\text{V}+2.9\times\text{Fe}+\text{Mo} \leqq 13\text{ to }15\text{ wt. }\%$$

As a preferable range of the above-specified composition, 7 to 13 wt. % is adopted as specified in eq.(2). If the value is less than 7 wt. %, then the stability of β phase and the decrease of β-transus become somewhat insufficient, and the workability also becomes insufficient. If the value exceeds 13 wt. %, the 15 phase becomes stable, and the β transus excessively lowers, and a slightly long period is needed for the precipitation of acicular α phase which contributes to the improvement of toughness, and the control of microstructure becomes difficult.

EXAMPLE

A Ti-4.5Al-3V-2Mo-2Fe alloy (β-transus temperature: 895° C.) was forged in a β phase region, and the alloy was rolled in an α+β phase region from 100 mm to 27 mm of plate thickness. The plate was subjected to the first heat treatment in a temperature range of from 820° to 910° C., followed by air-cooling. The plate was then subjected to the second heat treatment at 720° C., and was air-cooled. The cooling rate after the first heat treatment was 2° C./sec.

From the obtained plate with 27 mm thickness, fracture toughness test specimens of 1 inch were cut for compact tension type fracture toughness testing. The fracture toughness $K_{IC}$ was evaluated at room temperature by the method according to ASTM E399. In addition, tension test specimens were prepared, and the tensile properties were determined. The result is summarized in Table 1.

The reduction of area provides a measure of the ultimate local ductility of a material up to the instant of rapture. From the original and final areas, the percentage reduction of area is calculated in the following manner;

$$\{(\text{Original area}-\text{Final area})/\text{Original area}\}\times 100$$

As for a comparative example, a plate having a thickness of 27 mm which was prepared by rolling in a similar procedure as example described above. The sheet was subjected to the first heat treatment at a temperature range of from 720° to 910° C. for 1 hour followed by air-cooling. No second heat treatment was conducted. The material was tested for determining the tensile properties and the fracture toughness both at the room temperature. Table 2 shows the condition of heat treatment, the microstructure, the tensile characteristic, and the fracture toughness.

As a comparative alloy, a conventional Ti-6Al-4V alloy was taken and their fracture toughness and tensile property were cited from the "Titanium Alloy Fracture Toughness Data Book; published by the Titanium Material Study Committee of the Iron and Steel Institute of Japan". These characteristics are summarized in Table 3.

In the Table 3, WQ, AC and FC signifies the water quenching, air cooling and forced air cooling, respectively.

Figure 2:
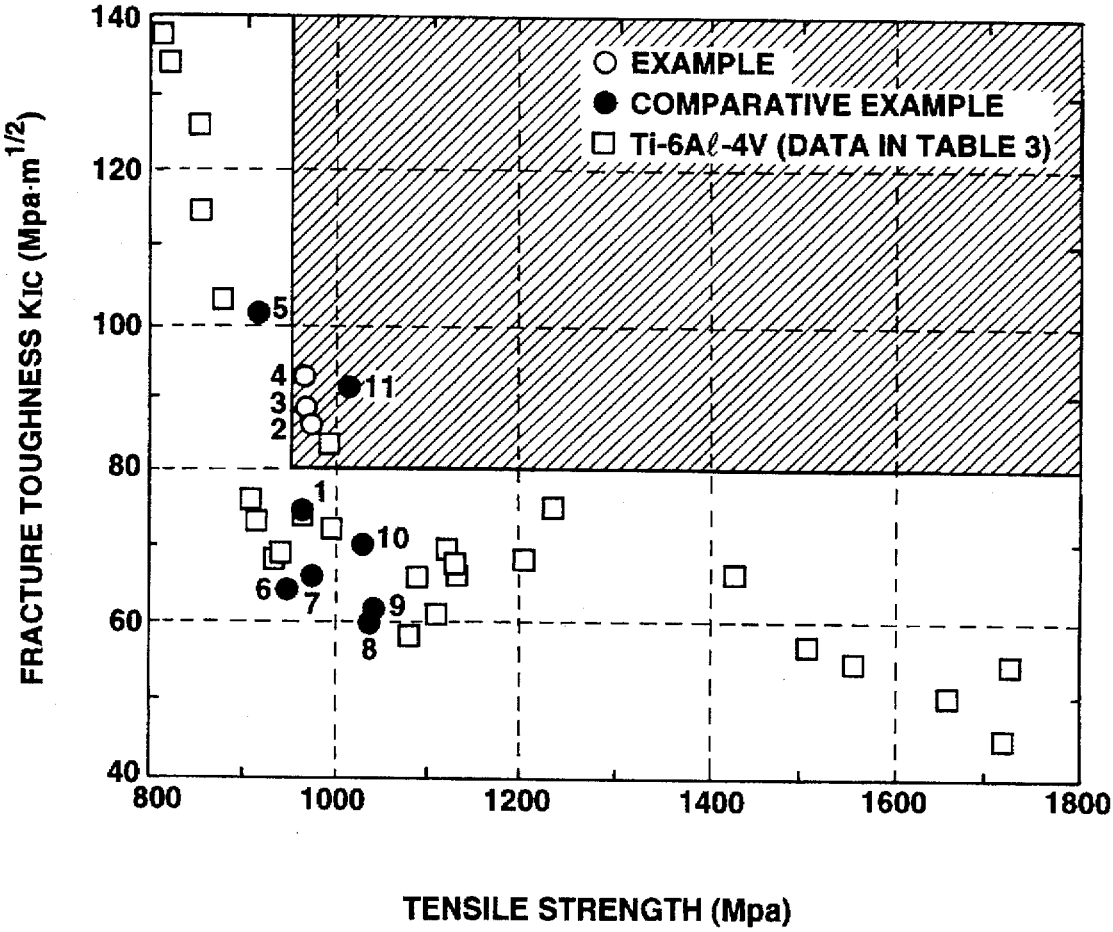
FIG. 2 is a graph which shows a relation between tensile strength and fracture toughness of various types of α+β titanium alloys.
Figure 3:
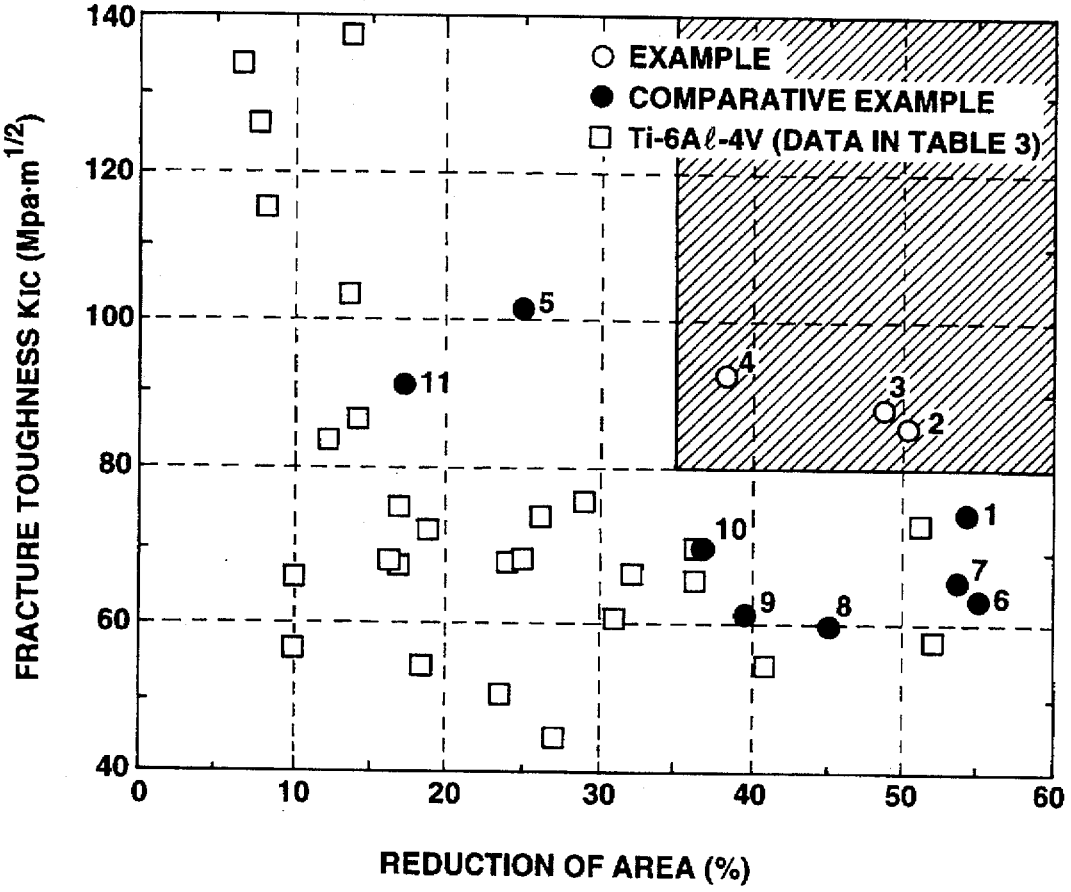
FIG. 3 is a graph which shows a relation between reduction of area and fracture toughness of various types of α+β titanium alloys.

FIG. 2 and FIG. 3 show a relation of strength and toughness and a relation of ductility and toughness of alloys which were heat-treated, respectively. The materials of the present invention give excellent properties such as tensile strength of 950 MPa or more, reduction of area of 35% or more, and fracture toughness of 80 MPa•$m^{1/2}$ or more.

These figures also show the relation of strength and toughness of a Ti-6Al-4 alloy ( 13-transus: 1000° C.) which is cited from the "Titanium Alloy Fracture Toughness Data Book; published by the Titanium Material Study Committee of the Iron and Steel Institute of Japan". These figures clearly show the superiority of the method of the present invention to the heat treatment method of the comparative example. Consequently, the example of the present invention gives superior balance of strength, ductility, and toughness.

As described above, the method of the present invention enables an α+β titanium alloy having relatively stable β phase to increase its toughness while maintaining a favorable balance with strength and ductility.

TABLE 1

| | No. | First heat treatment temperature | microstructure | tensile properties at room temperature: Tensile strength (MPa) | Elongation (%) | reduction of area (%) | KIC (Mpa · $m^{1/2}$) |
|---|---|---|---|---|---|---|---|
| Comparative example | 1 | 820 | bi-modal structure | 956 | 20.5 | 54.2 | 75.0 |
| Example | 2 | 840 | bi-modal structure | 971 | 19.8 | 50.2 | 86.5 |
| | 3 | 860 | bi-modal structure | 969 | 21.2 | 48.6 | 88.4 |
| | 4 | 880 | bi-modal structure | 963 | 15.8 | 38.2 | 92.3 |
| Comparative example | 5 | 910 | β heat treated structure | 912 | 10.0 | 32.0 | 101.5 |

* Condition of the second heat treatment: Holding at 720° C. for 1 hr, followed by air-cooling

TABLE 2

| | No. | First heat treatment temperature | microstructure | tensile properties at room temperature: Tensile strength (MPa) | Elongation (%) | reduction of area (%) | KIC (Mpa · $m^{1/2}$) |
|---|---|---|---|---|---|---|---|
| Comparative example | 6 | 800 | equiaxial two-phase structure | 948 | 20.2 | 55.0 | 63.6 |
| | 7 | 820 | bi-modal structure | 972 | 19.6 | 53.4 | 65.8 |
| | 8 | 840 | bi-modal structure | 1034 | 17.2 | 45.2 | 59.7 |
| | 9 | 860 | bi-modal structure | 1041 | 15.1 | 39.5 | 61.2 |
| | 10 | 880 | bi-modal structure | 1028 | 13.1 | 36.8 | 70.0 |
| | 11 | 910 | β heat treated structure | 1013 | 7.3 | 17.1 | 91.2 |

TABLE 3

| Condition of heat treatment | tensile properties at room temperature | | | |
|---|---|---|---|---|
| | Tensile strentgh (MPa) | Elongation (%) | reduction of area (%) | KiC (MPa · $m^{1/2}$) |
| Comparative example (cited data) | | | | |
| 815° C./1 h/WQ | 1125 | 13.7 | 16.7 | 68.0 |
| 815° C./1 h/WQ | 1231 | 13.5 | 16.7 | 75.3 |
| 815° C./1 h/WQ | 1427 | 14.6 | 10.2 | 66.2 |
| 750° C./1 h | 905 | 13.0 | 29.0 | 76.0 |
| 705° C./2 h | 1656 | 10.5 | 23.4 | 50.5 |
| 705° C./2 h | 1724 | 3.6 | 18.5 | 54.2 |
| 700° C./2 h | 1716 | 2.1 | 27.2 | 44.9 |
| 815° C./1 h/WQ + 540° C./4 h | 993 | 12.7 | 18.6 | 72.3 |
| 815° C./1 h/WQ + 540° C./4 h | 1198 | 11.3 | 16.1 | 68.4 |
| 815° C./1 h/WQ + 540° C./4 h | 1506 | 8.0 | 9.8 | 57.0 |
| 920° C./1 h/WQ + 540° C./4 h | 1077 | 15.0 | 52.0 | 58.0 |
| 920° C./1 h/WQ + 540° C./4 h | 1554 | 11.0 | 41.0 | 54.6 |
| 955° C./1.5 h/WQ + 540° C./6 h | 1163 | 7.0 | 21.0 | 44.6 |
| 950° C./1 h/AC + 720° C./2 h | 928 | 12.0 | 24.0 | 68.2 |
| 960° C./1 h/WQ + 800° C./1.5 h/WQ + 538° C./4 h | 1088 | 18.0 | 36.0 | 65.7 |
| 960° C./1 h/WQ + 860° C./1.5 h/WQ + 538° C./4 h | 1117 | 18.0 | 36.0 | 69.8 |
| 960° C./1 h/WQ + 900° C./1.5 h/WQ + 538° C./4 h | 1107 | 17.0 | 31.0 | 60.8 |
| 980° C./1 h/WQ + 900° C./1.5 h/WQ + 538° C./4 h | 1127 | 16.0 | 32.0 | 66.7 |
| 950° C./1 h/AC + 720° C./2 h | 961 | 10.8 | 26.0 | 74.2 |
| 950° C./1 h/AC + 720° C./2 h | 938 | 11.0 | 25.0 | 68.9 |
| 1065° C./1 h/FC + 540° C./4 h | 850 | 10.2 | 8.8 | 125.5 |
| 1065° C./96 h/FC + 540° C./4 h | 813 | 2.2 | 6.3 | 137.7 |
| 1065° C./1 h/AC + 540° C./4 h | 875 | 9.3 | 13.5 | 103.3 |
| 1065° C./24 h/AC + 540° C./4 h | 853 | 4.8 | 7.9 | 115.0 |
| 1050° C./0.5 h/AC + 730° C./2 h | 912 | 17.0 | 51.0 | 73.2 |
| 1070° C./0.5 h/AC | 980 | 9.6 | 14.0 | 86.8 |

What is claimed is:

1. A method for making an α+β titanium alloy comprising:

(a) preparing an α+β titanium alloy having a Mo.eq. of 2 to 10 wt. %, the Mo.eq. being defined by the following equation:

$$Mo.eq.=Mo+0.67\times V+0.44\times W+0.28\times Nb+0.22\times Ta+2.9\times Fe+1.6\times Cr+1.1\times Ni+1.4\times Co+0.77\times Cu-Al;$$

(b) hot-working the titanium alloy from step (a) in an α+β phase region;

(c) heating the hot-worked titanium alloy from step (b) to a temperature from β-transus minus 55° C. to β-transus minus 10° C.;

(d) heat treating the heated titanium alloy at the temperature from β-transus minus 55° C. to β-transus minus 10° C. from step (c);

(e) air cooling the heat treated titanium alloy from step (d);

(f) heating the air cooled titanium alloy from step (e) to a temperature from β-transus minus 250° C. to β-transus minus 120° C.;

(g) heat treating the heated titanium alloy at the temperature from β-transus minus 250° C. to β-transus minus 120° C. from step (f); and (h) air cooling the heat treated titanium alloy from step (g).

2. The method of claim 1, wherein the hot working is a rolling having a reduction ratio of at least 5%.

3. The method of claim 2, wherein the reduction ratio is at least 30%.

4. The method of claim 1, wherein the hot working is a forging having a reduction ratio of at least 5%.

5. The method of claim 4, wherein the reduction ratio is at least 30%.

6. The method of claim 1, wherein the heat treating of the step (d) and the heat treating of the step (g) are each carried out for a duration of at least 30 minutes.

7. The method of claim 6, wherein the heat treating of the step (d) and the heat treating of the step (g) are each carried out for a duration of at least 60 minutes.

8. The method of claim 1, wherein the contents of W, Nb, Ta, Cr, Ni, Co and Cu are zero;

the Mo.eq. being 2 to 10 wt. %, the Mo.eq. being represented by the following equation:

$$Mo.eq.=Mo+0.67\times V+2.9\times Fe-Al.$$

9. The method of claim 1, wherein the contents of W, Nb, Ta, Cr, Ni, Co and Cu are zero;

the Al content is 3 to 5 wt. %; and the value of

Mo+0.67V+2.9×Fe is 5 to 15 wt. %.

10. The method of claim 9, wherein the value of Mo+0.67×V+2.9×Fe is 7 to 13 wt. %.

11. The method of claim 1, wherein the titanium alloy consists essentially of 3 to 5 wt. % Al, 2.1 to 3.7 wt. % V, 0.85 to 3.15 wt. % Mo, 0.85 to 3.15 wt. % Fe, 0.06 to 0.2 wt. % O.

12. The method of claim 11, wherein the titanium alloy consists essentially of 3.4 to 5 wt. % Al, 2.1 to 3.7 wt. % V, 0.85 to 2.4 wt. % Mo, 0.85 to 3.15 wt. % Fe, 0.06 to 0.2 wt. % O.

13. A method for making an α+β titanium alloy comprising:

(a) preparing an α+β titanium alloy consisting essentially of 3 to 5 wt. % Al, 2.1 to 3.7 wt. % V, 0.85 to 3.15 wt.

% Mo, 0.85 to 3.15 wt. % Fe, 0.06 to 0.2 wt. % O and the titanium alloy satisfying the following equation:

$$7 \text{ wt } \% \leqq 0.67 \times V + 29 \times Fe + Mo \leqq 13 \text{ wt } \%;$$

(b) hot-working the titanium alloy from step (a) in an $\alpha+\beta$ phase region;

(c) heating the hot-worked titanium alloy from step (b) to a temperature from β-transus minus 55° C. to β-transus minus 10° C.;

(d) heat treating the heated titanium alloy at the temperature from β-transus minus 55° C. to β-transus minus 10° C. from step (c);

(e) air cooling the heat treated titanium alloy from step (d);

(f) heating the air cooled titanium alloy from step (e) to a temperature from β-transus minus 250° C. to β-transus minus 120° C.;

(g) heat treating the heated titanium alloy at the temperature from β-transus minus 250° C. to β-transus minus 120° C. from step (f); and (h) air cooling the heat treated titanium alloy from step (g).

14. The method of claim 13, wherein the hot working is a rolling having a reduction ratio of at least 5%.

15. The method of claim 14, wherein the reduction ratio is at least 30%.

16. The method of claim 13, wherein the hot working is a forging having a reduction ratio of at least 5%.

17. The method of claim 16, wherein the reduction ratio is at least 30%.

18. The method of claim 13, wherein the heat treating of the step (d) and the heat treating of the step (g) are each carried out for a duration of at least 30 minutes.

19. The method of claim 18, where the heat treating of the step (d) and the heat treating of the step (g) area each carried out for a duration of at least 60 minutes.

20. The method of claim 13, wherein the titanium alloy consisting essentially of 3.4 to 5 wt. % Al, 2.1 to 3.7 wt. % V, 0.85 to 2.4 wt. % Mo, 0.85 to 3.15 wt. % Fe, 0.06 to 0.2 wt. % O.

* * * * *